United States Patent [19]

Etchells

[11] 3,975,351

[45] Aug. 17, 1976

[54] PLASTICIZERS AS ADHESION PROMOTERS IN POLYESTER/POLYAMIDE HETEROFILAMENTS

[75] Inventor: Sylvia Etchells, Pontypool, England

[73] Assignee: Imperial Chemical Industries Inc., London, England

[22] Filed: Jan. 27, 1972

[21] Appl. No.: 221,419

Related U.S. Application Data

[63] Continuation of Ser. No. 886,783, Dec. 19, 1969, abandoned.

[52] U.S. Cl. ..... 260/30.8 R; 260/31.8 M; 260/31.8 XA; 260/32.6 NA; 260/33.2 R; 260/33.4 R

[51] Int. Cl.[2] ..... C08K 5/06; C08K 5/12; C08K 5/17; C08K 5/42

[58] Field of Search ..... 260/33.2 R, 857 PE, 260/37 NP, 40 P, 30.8 R, 31.8 M, 31.8 XA, 32.6 NA, 33.4 R

[56] References Cited

UNITED STATES PATENTS

| | | | |
|---|---|---|---|
| 2,374,069 | 4/1945 | Balthis | 264/211 X |
| 2,706,722 | 4/1955 | Caldwell | 260/33.2 R |
| 3,038,235 | 6/1962 | Zimmerman | 161/175 X |
| 3,192,295 | 6/1965 | Settele | 264/171 |
| 3,378,055 | 4/1968 | Robertson | 260/857 |
| 3,522,329 | 7/1970 | Okazaki et al. | 260/857 |

*Primary Examiner*—Lewis T. Jacobs
*Assistant Examiner*—S. M. Person
*Attorney, Agent, or Firm*—Herbert M. Adrian, Jr.

[57] ABSTRACT

The present invention relates to a process for improving the adhesion between normally non-adhesive components in a multi-component polymeric fiber by the addition of one or more defined plasticizers to one or more of the components.

18 Claims, No Drawings

PLASTICIZERS AS ADHESION PROMOTERS IN POLYESTER/POLYAMIDE HETEROFILAMENTS

This is a continuation, of application Ser. No. 886,783 filed Dec. 19, 1969, and now abandoned.

The present invention relates to adhesion and more particularly to adhesion between synthetic polymeric materials.

The term "fibre" is used hereinafter to indicate a unit of matter characterised by flexibility, fineness and a high ratio of length to thickness, and embraces continuous filaments, staple fibres including flock and fibres derived from partially slitting film.

Since their conception, fibres derived from synthetic polymers have played an ever increasing role in human society which has meant, inter alia, that most synthetic fibres have at some time been subjected to chemical and/or physical modification so as to create new properties or improve old ones.

One such modification has been that of combining two or more different polymer species to form a single fibre. Commonly, only two polymer species are involved and for convenience the present invention will be described hereinafter with respect to such bi-component fibres.

In a bi-component fibre, the components are usually arranged in either side-by-side or sheath/core relationship. Obviously, such an arrangement will carry with it the properties of both components and by the careful selection of those components, it is possible to predetermine to some extent the ultimate properties of the fibre.

Admirable though such an arrangement may be, however, polymer incompatability often leads to the partial or complete separation of components when bi-component fibres are subjected to conventional textile operations, such as, bulking, knitting or weaving, with a concomitant loss in the value of such fibres; such separation occuring at the interface between the components.

Minimising the likelihood of component separation in bi-component fibres would, accordingly, be particularly useful, as it would allow for the unhindered and complete exploitation of such fibres.

Unexpectedly, it has been found that the addition of small quantities of plasticisers to one or more of the normally non-adhesive components in a bi-component fibre can significantly improve the adhesion between the components.

The term "plasticiser" is used in this specification to denote a material incorporated in a plastic to increase its workability and its flexibility or distensibility.

Accordingly, the present invention provides a multi-component polymeric fibre in which components that are normally non-adhesive in behaviour are caused to bond together by the addition of one or more plasticisers as herein defined to one or more of the components.

In a bi-component fibre it is preferred to add the plasticiser or plasticisers to one of the components only.

In the case of polyamide/polyester component systems, additives falling within the following classes have been found effective.

For either component:

Ethers, e.g. diphenyl ether.

Hydrocarbons, e.g. diphenyl, dibenzylbenzene

Sulphonamides, e.g. N-cyclohexyl p-toluene sulphonamide (Santicizer 1H Santicizer is a Registered Trade Mark), a mixture of o- and p-N-ethyl toluene sulphonamides (Santicizer 8), N-phenyl benzene sulphonamide, m-phenylene N,N'-dibenzene sulphonamide, dicyclohexyl methane N,N'-dibenzene sulphonamide, p-N-cyclohexyl benzene sulphonamide, and certain other sulphonanilides.

Preferably for the polyamide component only: Melamines, e.g. melamine Phenols, e.g. p-nonyl phenol.

Preferably for the polyester component only: Esters of carboxylic acids, e.g. dialkyl phthalates Esters of phosphoric acids, e.g. triphenyl phosphate Since the plasticisers of the present invention are incorporated in polymer components that are to be subjected to the rigours of extrusion, they must possess the necessary stability to survive such an operation, for example, in melt spinning, thermal stability, non-volatility and chemical inertness at melt-spinning temperatures.

The presence of not more than 15% by weight of total plasticiser in any particular multi-component fibre is envisaged with preferably not more than 10% by weight in any single component.

The plasticiser or plasticisers may be introduced at any appropriate stage in the preparation of the normally non-adhesive polymer and in the case of polyamides and polyesters, introduction at the beginning of the polymerisation cycle has been found convenient.

In particular the present invention is applicable to bi-component fibres derived from polyhexamethylene adipamide, polycaprolactam and polyethylene terephthalate.

The improvement in adhesion has been found to be apparent in both, as conventionally described, undrawn and drawn fibres.

The following examples illustrate but do not limit the present invention.

EXAMPLE 1

2.5 parts of diphenyl ether were mixed with 97.5 parts of polyethylene terephthalate for one hour at 285°C under nitrogen. The resulting polymer was melt spun as one component of a 26 filament 50/50 side-by-side bi-component filament yarn. Polyhexamethylene adipamide was used as the other component.

A similar, control yarn was spun with unmodified polyethylene terephthalate as one component and polyhexamethylene adipamide as the other.

Both yarns were drawn over a hot plate at 180°C to a draw ratio of 3.0 and the drawn yarns subjected to the following abrasion test.

50 cms lengths of the drawn yarns were suspended over a 15 cm diameter cylinder covered with emery cloth grade 00, the yarns being held taut by a 10 gram weight attached to one end.

The cylinder was then rotated at 500 rpm and the yarn was examined under the microscope after 5,000 and 10,000 revolutions had been completed.

| Sample | Number of split filaments | |
|---|---|---|
| | After 5,000 revs. | After 10,000 revs. |
| Polyethylene terephthalate /Polyhexamethylene adipamide | 26 | 26 |
| Polyethylene terephthalate + 2.5% diphenyl ether /Polyhexamethylene adipamide | 0 | 6 |

EXAMPLE 2

5 parts of p - nonyl phenol were melt blended with 95 parts of polyhexamethylene adipamide at 285°C for 15 minutes. The resulting polymer was spun as one component of a 50/50 side-by-side bi-component filament yarn, polyethylene terephthalate being used as the other component. The resulting yarn was drawn over a hot plate to a draw ratio 5.0. No fibrillation was observed either on drawing the yarn or on subsequently abrading the drawn yarn 12 times over a glass edge.

A control bi-component filament yarn spun using unmodified polyhexamethylene adipamide with polyethylene terephthalate fibrillated completely on drawing.

EXAMPLE 3

The experiment described in Example 2 was repeated except that 5 parts of m-phenylene N,N'-dibenzene sulphonamide were used in place of the p - nonyl phenol. A similar improvement in adhesion between the two components resulted.

EXAMPLE 4

The experiment described in Example 2 was repeated except that 5 parts of diphenyl ether were used in place of the p - nonyl phenol. Good adhesion between the two components was obtained.

EXAMPLE 5

2.5 parts of melamine were melt blended with 97.5 parts of polyhexamethylene adipamide at 285°C for 15 minutes. The resulting polymer was spun as one component of a 50/50 side-by-side bi-component filament yarn, polyethylene terephthalate being used as the second component. After drawing over a plate at 180°C to a draw ratio of 5.0, no fibrillation of the two components was observed.

EXAMPLE 6

5 parts of N- phenyl benzene sulphonamide were melt blended with 95 parts of polyethylene terephthalate at 285°C for 15 minutes. The resulting polymer was spun as one component of a 50/50 side-by-side bi-component filament yarn with polyhexamethylene adipamide as the other component. On drawing the yarn over a plate at 180°C and abrading the yarn 12 times over a glass edge no separation of the two components was observed.

EXAMPLE 7

5 parts of a mixture of ortho and para N- ethyl toluene sulphonamides (Santicizer 8) were melt blended with 95 parts of polyethylene terephthalate at 285°C for 15 minutes. The polymer was spun as one component of a side-by-side 50/50 bi-component filament yarn with polyhexamethylene adipamide as the other. The yarn was drawn over a hot plate at 180°C and subjected to abrasion over a glass edge. Good adhesion between the two components was obtained.

EXAMPLE 8

7,450 parts of hexamethylene diammonium adipate, 340 parts of a mixture of ortho and para N- ethyl toluene sulphonamides (Santicizer 8), 4.5 parts of acetic acid and 2,800 parts of water were stirred together in an autoclave and heated to 205°C during one hour, reaching a pressure of 250 lbs. per square inch. The temperature was then raised to 240°C during one hour whilst the pressure was maintained. During the next hour, the pressure was allowed to fall to one atmosphere while the temperature was raised to 285°C. The polymer was then finally heated at 285°C for 35 minutes and extruded in a thin ribbon.

The resulting white polymer was melt spun as the sheath of a 20 filament 70/30 core/sheath bi-component filament yarn, polyethylene terephthalate being used as the core. The yarn was subsequently drawn and crimped using a sutffer box. Examination of the bulked yarn under the microscope showed that the sheath remained adhered to the core. In a control experiment on a yarn with an unmodified polyhexamethylene adipamide sheath and a polyethylene terephthalate core, complete removal of the sheath from the core occurred during bulking.

EXAMPLE 9

5 parts of para N-cyclohexyl benzene sulphonamide were melt blended with 95 parts polycaprolactam at 285°C for 15 minutes. The resulting polymer was spun as one component of a 50/50 side-by-side bi-component filament yarn, polyethylene terephthalate being used as the other component. The resulting yarn was drawn over a hot plate at 180°C. Abrading the drawn yarn 12 times over a glass edge produced no fibrillation of the two components.

A control yarn using unmodified polycaprolactam with polyethylene terephthalate fibrillated on drawing.

EXAMPLE 10

2.5 parts of dimethylphthalate were melt blended with 97.5 parts of polyethylene terephthalate at 285°C for 10 minutes. The resulting polymer was spun as one component of a 50/50 side-by-side bi-component filament yarn, polyhexamethylene adipamide being the other component. The yarn was drawn over a hot plate at 180°C to a draw ratio of 3.0. No fibrillation of the two components was observed.

EXAMPLE 11

5 parts of N-cyclohexyl p-toluene sulphonamide were melt blended with 95 parts of a copolyamide comprising 77.5 parts of polyhexamethylene adipamide and 22.5 parts of polycaprolactam at 285°C for 15 minutes. The resulting polymer was melt spun as one component of a 50/50 side-by-side bi-component filament yarn, polyethylene terephthalate being the other component. The yarn was drawn over a hot plate at 180°C and subsequently abraded on a glass edge. Good adhesion between the components was observed.

What I claim is:

1. A process for improving adhesion between heterofilament components of polyester and polyamide, which components are normally nonadhesive to the other component of said heterofilament comprising modifying at least one component of said heterofilament by adding a plasticizer to said component in an amount up to 15 percent by weight of said component prior to extruding said component into said heterofilament configuration.

2. A process as claimed in claim 1 in which not more than 10% by weight of one or more plasticizers is added to any one component.

3. A process as claimed in claim 1 wherein the heterofilament is a polyester-polyamide side-by-side filament.

4. A process as claimed in claim 3 in which di-phenyl ether is added to at least one of the components.

5. A process as claimed in claim 3 in which m-phenylene N,N'-dibenzene sulphonamide is added to at least one of the components.

6. A process as claimed in claim 3 in which N-phenyl benzene sulphonamide is added to at least one of the components.

7. A process as claimed in claim 3 in which o- and p-N-ethyl toluene sulphonamide are added to at least one of the components.

8. A process as claimed in claim 3 in which p-N-cyclohexyl benzene sulphonamide is added to at least one of the components.

9. A process as claimed in claim 3 in which N-cyclohexyl p-toluene sulphonamide is added to at least one of the components.

10. A process as claimed in claim 3 in which p-nonyl phenol is added to the polyamide component.

11. A process as claimed in claim 3 in which melamine is added to the polyamide component.

12. A process as claimed in claim 3 in which dimethyl phthalate is added to the polyester component.

13. The process as claimed in claim 1 wherein the heterofilament is a polyester-polyamide sheath-core filament.

14. A heterofilament of at least two polymer components comprising one component of polyester or polyamide and a second component of a fiber-forming polymer normally nonadhesive to said polyester or polyamide at least one of said components having a plasticizer incorporated therein in an amount up to 15 percent by weight of said component.

15. The heterofilament of claim 14 wherein the components are polyester and polyamide.

16. The heterofilament of claim 15 wherein the heterofilament is a side-by-side configuration.

17. The heterofilament of claim 15 wherein the heterofilament is a sheath-core configuration.

18. The heterofilament of claim 15 wherein diphenyl ether is the plasticizer added to one of the components.

* * * * *